US010435053B2

(12) United States Patent
Bresson et al.

(10) Patent No.: US 10,435,053 B2
(45) Date of Patent: Oct. 8, 2019

(54) OPTIMIZED CIRCULATION MANAGEMENT METHOD OF A TRAIN AND ASSOCIATED CBTC SIGNALING SYSTEM

(71) Applicant: ALSTOM Transport Technologies, Saint-Ouen (FR)

(72) Inventors: Mathieu Bresson, Paris (FR); Javier Ballesteros, Paris (FR)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 0 days.

(21) Appl. No.: 15/987,471

(22) Filed: May 23, 2018

(65) Prior Publication Data

US 2018/0339721 A1 Nov. 29, 2018

(30) Foreign Application Priority Data

May 24, 2017 (FR) ..... 17 54618

(51) Int. Cl.

| | |
|---|---|
| ***B61L 27/00*** | (2006.01) |
| ***B61L 21/04*** | (2006.01) |
| ***B61L 3/22*** | (2006.01) |
| ***B61L 21/10*** | (2006.01) |

(52) U.S. Cl.

CPC ..... *B61L 27/0038* (2013.01); *B61L 3/225* (2013.01); *B61L 21/04* (2013.01); *B61L 21/10* (2013.01); *B61L 2027/005* (2013.01)

(58) Field of Classification Search

CPC ..... B61L 27/0038; B61L 21/04; B61L 21/10; B61L 3/225

See application file for complete search history.

(56) References Cited

U.S. PATENT DOCUMENTS

| | | | | |
|---|---|---|---|---|
| 5,947,423 | A * | 9/1999 | Clifton | B61L 3/225 246/167 R |
| 9,663,125 | B2 * | 5/2017 | Myokei | B61L 15/0063 |
| 2007/0084972 | A1 * | 4/2007 | Riley | B61L 1/14 246/77 |

(Continued)

FOREIGN PATENT DOCUMENTS

| | | |
|---|---|---|
| EP | 2921369 | 9/2015 |

OTHER PUBLICATIONS

Preliminary Search Report for FR 1754618, dated Jan. 18, 2018.
Written Opinion for FR 1754618, dated Jan. 18, 2018.

*Primary Examiner* — Jason C Smith
(74) *Attorney, Agent, or Firm* — B. Aaron Schulman, Esq.; Stites & Harbison, PLLC

(57) ABSTRACT

When an event prevents a train from moving along a route in a nominal direction, this method makes it possible to cause it to circulate in an opposite direction by: selecting (120) an origin zone and an output signal; drawing (130) a pseudo-route on the successive zones between the origin zone and the output signal; opening (140) the pseudo-route by associating a sub-route with each zone, corresponding to the reservation of said zone for said train; informing (150) the train that it must circulate in the opposite direction; determining (160) a movement authorization for the train from sub-routes that are open and a list of obstacles that is updated regularly; sending (180) the movement authorization to the train, the determination (160) and transmission (170) steps being iterated until the train crosses the output signal.

13 Claims, 3 Drawing Sheets

(56) References Cited

U.S. PATENT DOCUMENTS

| | | | | |
|---|---|---|---|---|
| 2016/0039437 | A1* | 2/2016 | Miyajima | B60L 15/40<br>701/19 |
| 2017/0113707 | A1* | 4/2017 | Ghaly | B61L 3/16 |
| 2018/0312182 | A1* | 11/2018 | Prestail | B61L 3/006 |
| 2018/0339721 | A1* | 11/2018 | Bresson | B61L 3/225 |

* cited by examiner

OPTIMIZED CIRCULATION MANAGEMENT METHOD OF A TRAIN AND ASSOCIATED CBTC SIGNALING SYSTEM

The invention relates to the field of methods for managing the circulation of a train along a section of railroad track, implemented by a signaling system of the "Communication-Based Train Control" (CBTC) type, the signaling system being able, in a nominal mode, to define a route on the section allowing the circulation of the train in a nominal circulation direction, the route extending over a plurality of successive zones between an origin signal and a destination signal.

With a signaling system of the CBTC type, a train circulates along routes that are traced by a supervision system (ATS) and opened by an interlocking system (CBI).

A route corresponds to a section of the railroad track, which is traveled in a predetermined nominal circulation direction.

A section contains several successive zones between an origin signal and a destination signal.

The trend being to reduce the number of signals along the track, the length of the sections, and therefore of the routes, increases.

In the case where the trains follow one another at relatively small intervals, as is the case for a subway line, it is provided that several trains can circulate at the same time on a same section.

However, if a first train breaks down on a section, the trains engaged on this same section and following it are prevented from continuing their movement.

Indeed, in a CBTC architecture, when a train engages on a route that has been opened for it by the interlocking system, it must go to the destination signal.

Thus, in case of deviation in the nominal operation of the line, a large number of trains can be affected and must wait for the nominal operation to resume in order to continue their movement along the route on which they are engaged.

The invention therefore aims to resolve the aforementioned problem, in particular by proposing a downgraded traffic management mode by the CBTC signaling system, in which a train can be authorized to change circulation directions when it is engaged on a route, to cause it to leave the corresponding railroad track section.

To that end, the invention relates to a method for managing the circulation of a train along a railroad track section, implemented by a signaling system of the CBTC type, the signaling system being able, in a nominal mode, to define a route on the section allowing the circulation of the train in a nominal circulation direction, the route extending over a plurality of successive zones between an origin signal and a destination signal, characterized in that it consists, in case of occurrence of an event preventing the train from continuing its movement along said route, of causing the train to circulate in a circulation direction opposite the nominal circulation direction by:

- selecting an origin zone and an output signal;
- tracing, via a supervision system of the signaling system, a pseudo-route for the train on the successive zones between the origin zone and the output signal;
- opening, via an interlocking device of the signaling system, the pseudo-route by associating each zone between the origin zone and the output signal with a sub-route, each sub-route corresponding to the reservation of said zone for said train in the opposite circulation direction;

- informing the train that it must modify its current circulation direction so that it corresponds to the opposite circulation direction; and
- determining, via a zone controller of the signaling system, a movement authorization for the train from the current circulation direction of the train and sub-routes open for said train and taking account of the list of obstacles regularly updated by the zone controller;
- sending the movement authorization to the train to control the movement of said train, the steps for determining and sending a movement authorization being iterated until the train crosses the output signal.

According to specific embodiments, the method includes one or more of the following features, considered alone or according to any technically possible combinations:

- the list of obstacles for a train moving in a current circulation direction includes all of the movement authorizations already transmitted to the other trains circulating on said section in the direction opposite the current circulation direction;
- the list of obstacles, for a train moving in a current circulation direction, further includes a safety envelope calculated by the zone controller for another non-CBTC or non-communicating CBTC train circulating on said section;
- the list of obstacles, for a train moving in a current circulation direction, further includes a safety envelope calculated by the zone controller for another CBTC train being driven manually circulating on said section in the direction opposite the current circulation direction, the circulation direction of said CBTC train being driven manually being determined from an identifier of its active cabin;
- the interlocking system locks a sub-route for a train as long as: said train occupies the zone associated with said sub-route; or said train does not occupy the zone associated with said sub-route, but another sub-route, which is associated with a zone that precedes, in the circulation direction of said sub-route, the zone associated with said sub-route, is locked;
- the method includes an initial step for selecting the train engaged on the railroad track section that must circulate in a circulation direction opposite the nominal circulation direction;
- the method includes a configuration step consisting of defining each zone of the railroad track that may be used as origin zone of a pseudo-route.

The invention also relates to a signaling system of the CBTC type for carrying out a method for managing the circulation of a train along a section of a railroad track according to the preceding method, the signaling system including a supervision system, a zone controller and an interlocking system, characterized in that:

- the supervision system is able to trace a pseudo-route between an origin zone and a destination signal for said train;
- the interlocking system is able to open a pseudo-route traced by the supervision system, by defining, for each zone of the pseudo-route, a sub-route reserving, for said train, said zone in a particular circulation direction; and
- the zone controller is able to keep a list of obstacles updated and determine a movement authorization for the train taking the list of obstacles into account.

According to specific embodiments, the system includes one or more of the following features, considered alone or according to any technically possible combinations:

the list of obstacles includes movement authorizations sent to the other trains circulating on the section;

the list of obstacles further includes safety envelopes calculated around each of the non-CBTC or non-communicating CBTC trains, circulating on the section;

the list of obstacles further includes safety envelopes calculated around each of the CBTC trains being driven manually, circulating on the section, each safety envelope being associated with an identifier of the active cabin of the corresponding CBTC train being driven manually;

the supervision system is configured so as to define the zones of the section of the railroad track able to be used as origin zone of a pseudo-route.

The invention will be better understood using the following description, provided solely as an illustrative and non-limiting example and done in reference to the appended drawings, in which:

FIG. 1 shows a signaling system 10 based on an ATC (Automatic Train Control) architecture of the Communication-Based Train Control (CBTC) type. A CBTC architecture is based on the presence of computers on board trains, also called ATP (Automatic Train Protection).

Figure 1:
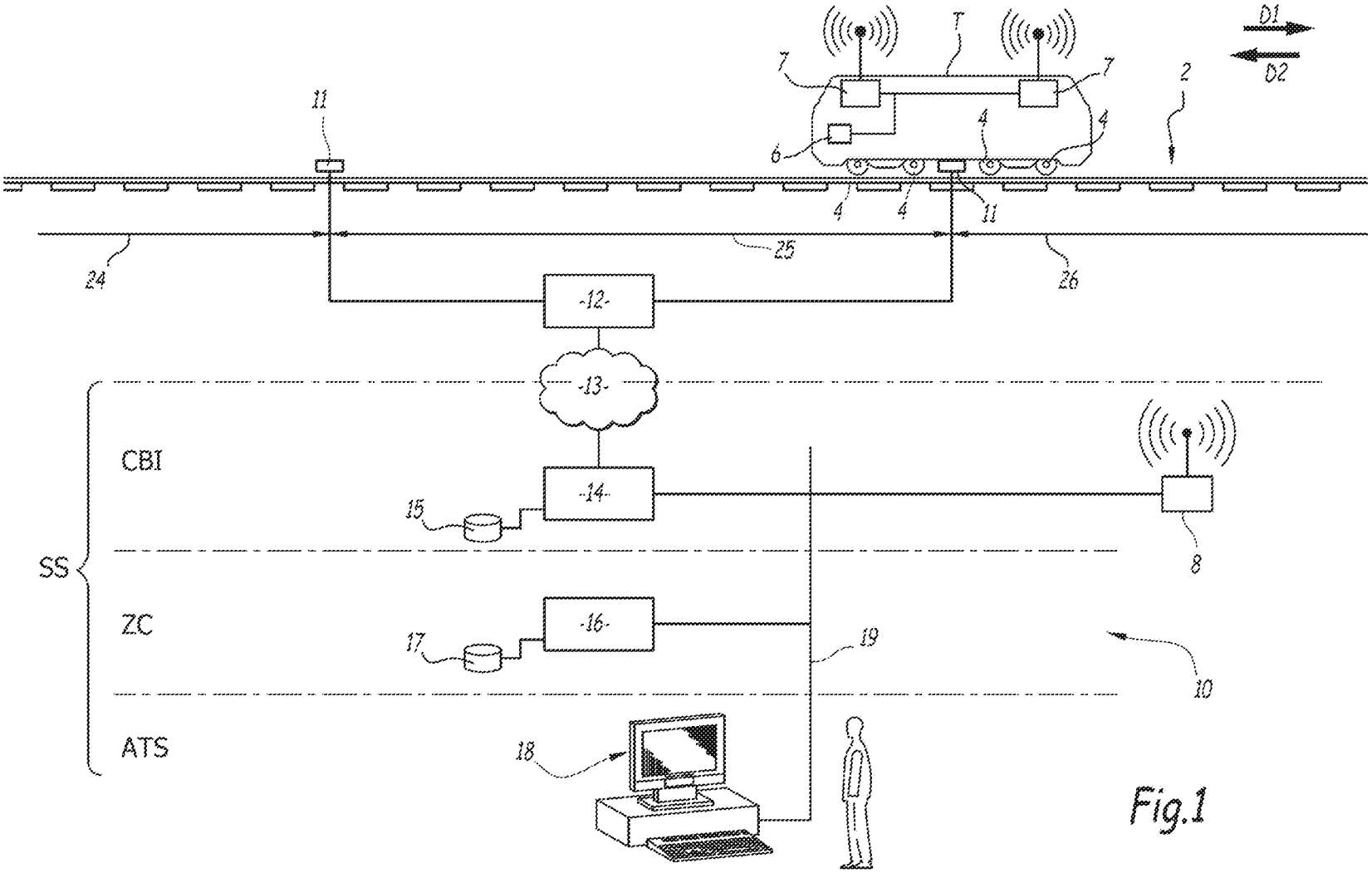
FIG. 1 is a schematic illustration of a CBTC signaling system able to carry out the method for managing the circulation of a train according to the invention.

Thus, in the signaling system 10, the computer 6 of the train T on the one hand covers the functional needs of the train T, i.e., for example the stations to be served, and on the other hand controls safety points, i.e., for instance verifies that the train T is not traveling at an excessive speed at a particular mileage point of the line.

Thus, the computer 6 of the train T determines a certain number of operating parameters of the train T and communicates with various systems on the ground to allow the train T to perform its assigned mission safely.

The computer 6 is at least connected to an onboard radio communication unit 7, able to establish a radio link with base stations 8 of a ground communication infrastructure, which in turn is connected to a communication network 19 of the CBTC architecture.

On the ground, the signaling system 10 includes an interlocking system 14, also called CBI (Computer-Based Interlocking). The CBI 14 is able to control the trackside equipment, such as signal lights, switching actuators, etc., this equipment allowing the trains to move safely while avoiding conflicting movements between them. Once based on electromechanical relays, today the interlocking system is computerized by suitable computers. The CBI 14 is situated away from the equipment of the track and is connected thereto by a suitable communication network 13, preferably of the ETHERNET type. In FIG. 1, the CBI 14 includes a storage memory 15, in particular for storing information relative to the sub-routes.

The signaling system 10 includes a zone controller (ZC) 16, which makes up the ground part of an ATP (Automatic Train Protection) system. The ZC 16 is in particular responsible on the one hand for monitoring the presence of the trains on the railroad network, and on the other hand, in a centralized architecture, for providing movement authorizations to the trains. These movement authorizations must guarantee the safe movements of the trains, i.e., for example not give a movement authorization to a train that would cause it to go past a train preceding it. In FIG. 1, the ZC 16 includes a storage memory 17, in particular for storing information relative to obstacles to be taken into account in determining movement authorizations.

The signaling system 10 comprises an automatic train supervision (ATS) system 18. The ATS 18 is implemented in an operational unit and comprises man/machine interfaces, allowing operators to intervene on the various components of the signaling system 10.

The railway network 2 is subdivided into sections, each section extending between two signaling signals and being subdivided into a plurality of zones. In FIG. 1, three successive zones 24, 25 and 26 are shown. One section is traveled by a train in a predetermined nominal circulation direction D1.

The occupancy of a zone is a key piece of information for railroad safety. The determination of this information, known by those skilled in the art, will now be generally described.

The ZC 16 receives information on the one hand from a primary detection system, and on the other hand from a secondary detection system, and reconciles this information to determine the occupied and free zones of the network.

The primary detection system determines the zone occupied by a train from the instantaneous position of the train calculated by the on-board computer of the latter. For example, this position is determined by the on-board computer from the detection of beacons installed along the track and whose geographical positions are known, and from measurements delivered by odometry sensors equipping the train and allowing the computer 6 to determine the distance traveled since the last beacon crossed.

From the instantaneous position, the ZC 16 uses a geographical map of the network, on which each zone is uniquely identified, to determine the zone in which the train is currently located. The zone is then placed in the "occupied" state. In this way, a first piece of occupancy information for each zone is determined by the ZC 16 and is stored in the memory 17.

The secondary detection system is able to back up the primary detection system, for instance in the case where the communication unit 7 of a train T is no longer working and the ZC 16 can no longer obtain the instantaneous position of the train. While a "purely CBTC" system can operate only with the primary detection, a secondary detection system is necessary on the one hand to cover the failure modes of the ground on-board communication for a CBTC train, and on the other hand to allow the circulation on the network of non-CBTC trains, i.e., that are not equipped with an onboard computer compatible with the CBTC architecture.

Using track sensors, the secondary detection system is able to detect the presence of a train in a zone. As shown in FIG. 1, these sensors can be axle counters 11 located at each end of a zone, like the zone 25. Thus, when the train T enters the zone 25, the upstream sensor 11 (in the nominal circulation direction D1) allows the incrementation by one unit of a state counter associated with the zone 25, each time the passage of an axle 4 of the train T is detected. When the train T leaves the zone 25, the downstream sensor 11 makes it possible to decrement the same state counter by one unit, each time the passage of an axle 4 of the train T is detected. Thus, the zone 25 is in the "free" state when the associated state counter is equal to zero. Otherwise, the zone 25 is in the "occupied" state.

In another embodiment, these sensors are "track circuits" making it possible to detect the presence of a short circuit between the lines of rails caused by the presence of the axle of a train.

In these two embodiments, the secondary detection system includes, aside from a plurality of sensors 11, a plurality of intermediate equipment items 12 making it possible to use analog measurement signals at the output of the sensors 11 to generate occupancy information. This is sent via the network 13 to the CBI 14, then to the ZC 16.

Figure 2:
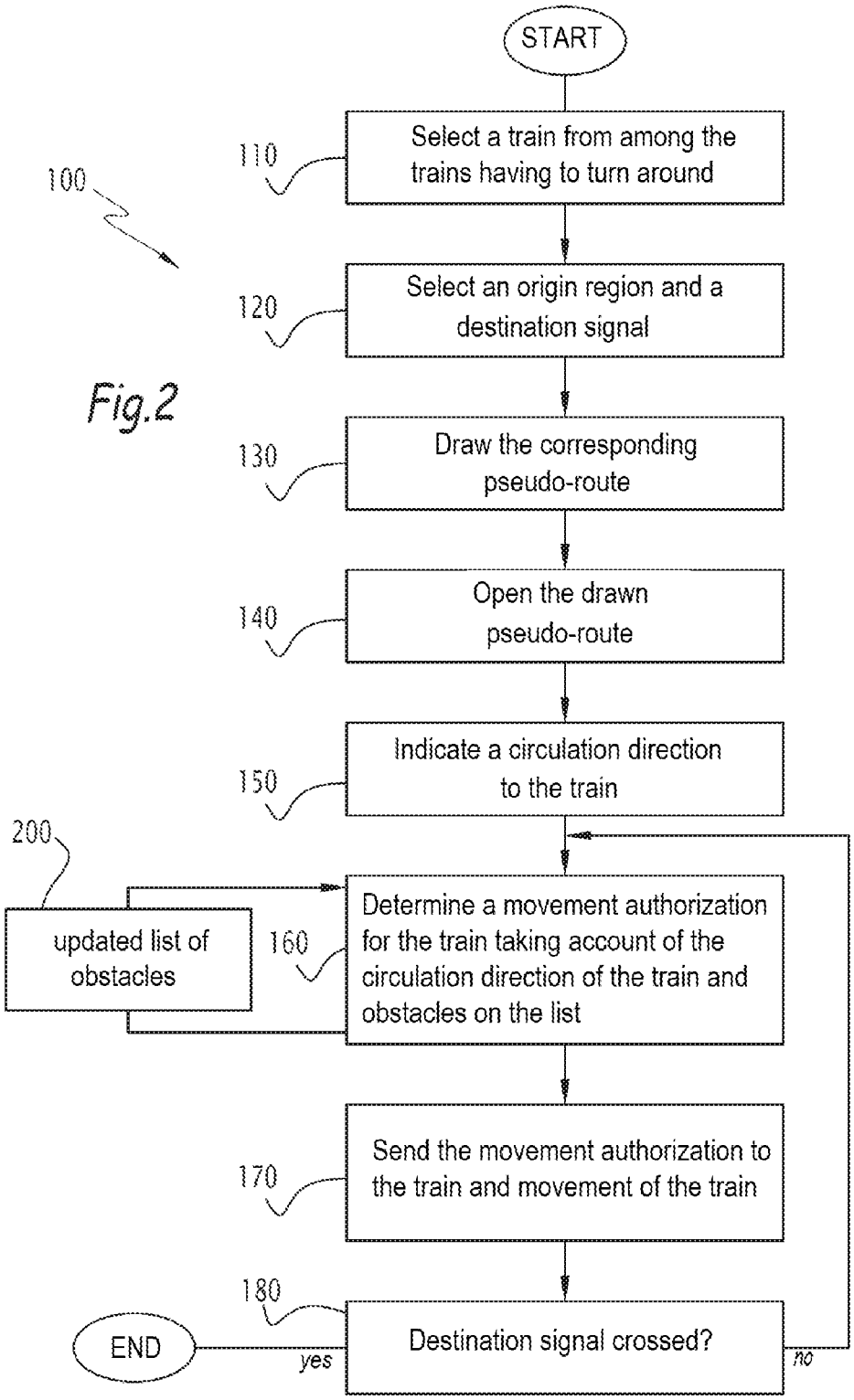
FIG. 2 is a schematic block illustration of one embodiment of the method according to the invention.

The method 100 according to the invention will now be described from FIG. 2, on the one hand, and FIGS. 3 to 9, on the other hand.

FIGS. 3 to 9 illustrate different moments of the traffic on the railroad track 2.

The railroad track 2 is subdivided into sections. Three sections A, B and C are shown in FIGS. 3 to 9.

Section B includes nine successive zones (referenced 20 to 28) between the signaling signals S1 and S3.

The zone 20, which incorporates a switch, has a shared border with section A. When the switch is positioned correctly, a train can enter section B from section A.

The zone 20 is framed by the signals S1 and S2.

The sections 21 to 28 are linear sections that follow one another and define a circulation track for the trains along a nominal circulation direction D1 (from left to right in FIGS. 3 to 9).

The zones 21, 24, 26 and 28 are more particularly associated with stations 31, 32, 33 and 34 allowing the exchange of passengers.

The zone 28 allows a train to leave the section B by engaging on the section C.

The section C includes a zone 29, which incorporates a switch and is framed by two signals S3 and S4.

In the nominal operating mode, a route R is associated with the section B, delimited by the signal S1 as origin signal and the signal S3 as destination signal.

Figures 3, 4, 5, 6, 7, 8, 9:
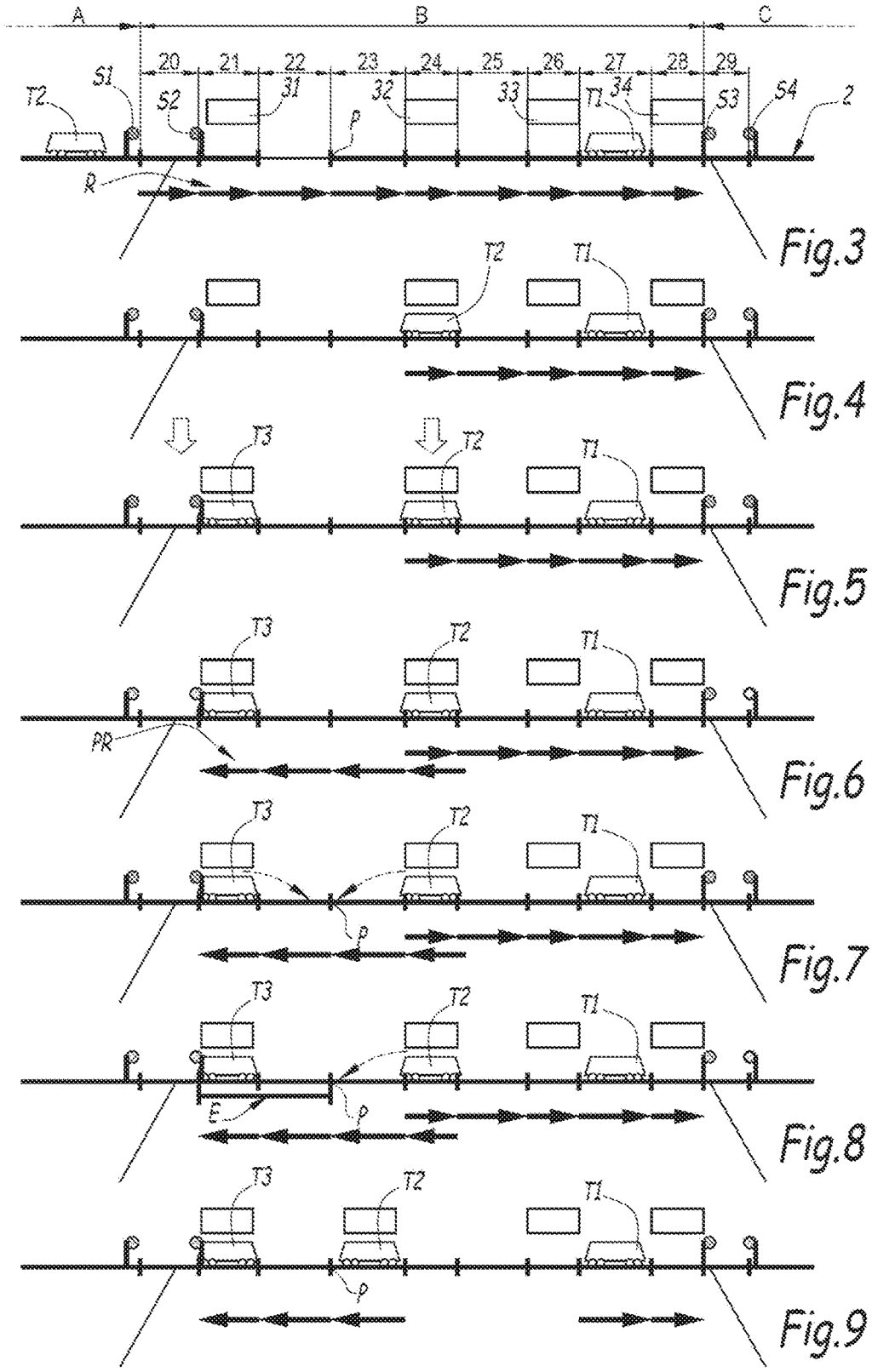
FIGS. 3 to 9 show different steps of the operation of a line, equipped with the CBTC signaling system of FIG. 1, during which operation the method according to the invention is carried out.

As illustrated by FIG. 3, to carry out the mission of the train T2 and while the train T2 is approaching the border between the sections A and B, the ATS 18 traces the route R for the train T2.

The ATS 18 communicates this route R to the CBI 14.

The CBI 14 opens this route R while reserving, for the train T2, each of the zones 20 to 28 in the nominal circulation direction D1. Thus, for the train T2, the CBI 14 locks objects called sub-routes: a sub-route associates a zone reserved for the train T2 and a circulation direction of the train T2 in this zone. The sub-routes are stored in the memory 15 associated with the CBI 14.

The ZC 16 next determines, from sub-routes locked for the train T2 and the current circulation direction of the train T2 corresponding to the nominal circulation direction D1, a movement authorization. This movement authorization is determined based on zones of the route R opened for the train T2 that are occupied by other trains. In the case at hand, in FIG. 3, the zone 27 is occupied by a train T1. The train T1 moves in the nominal circulation direction D1. It precedes the train T2 on the section B. As a result, the movement authorization delivered to the train T2 by the ZC 16 extends at furthest to the border between the zones 26 and 27.

As shown in FIG. 4, and according to the movement authorization that it has received from the ZC 16, the train T2 engages on the route R. It enters the section B while crossing the origin signal S1. It next progresses along the route R.

Each time the train T2 crosses the border between two zones of the route R, the CBI 14 frees the sub-route associated with the zone that the train T2 has just left. Thus, in FIG. 4, when the train T2 is in the zone 24, the zones 20 to 23 previously locked are now freed. They are erased from the memory 15 of the CBI 14.

The maintenance of a sub-route in the locked state by the CBI 14 meets the following two conditions:

- the train for which the route was opened occupies the zone associated with the considered sub-route; or
- the train for which the route was opened is not in the zone associated with the considered sub-route, but the sub-route associated with the zone that precedes, in the nominal circulation direction, the zone associated with the considered sub-route is in the locked state.

A contrario, if one or the other of these two conditions is not met, the CBI 14 frees the considered sub-route.

In the nominal mode, the train T1 should continue its movement in the nominal circulation direction D1 and ultimately leave the section B by crossing the signal S3. Upon each movement of the train T1, the ZC 16 determines the zones of the route R that are no longer occupied by the train T1 and updates the movement authorization of the train T2. In the nominal mode, the train T2 should therefore continue its movement along the route R to leave the section B by crossing the signal S3.

However, if an event occurs preventing the train T1 from continuing its movement, the train T2 is also prevented from continuing its movement. In the nominal mode, the train T2 is blocked.

Such an event may for example be a failure of the train T1 or a person on the track at the zone 28 requiring the electrical power supply in this zone to be cut, such that the train T1 can no longer continue its movement.

The method 100 according to the invention is then carried out as follows.

When the event occurs preventing the continuation of normal operation, an operator decides to switch the signaling system 10 into a downgraded mode for operation of the line in which the trains will be authorized to turn around and their maneuvers supervised safely.

In step 110, from the control center of the ATS 18, the operator takes control and selects a train engaged on the considered track section to cause it to change circulation directions so that it leaves the considered section. Thus, as illustrated in FIG. 5, the operator selects the train T2 so that it moves in an opposite circulation direction D2, which is the direction opposite the nominal circulation direction D1, so that it leaves the section B on which it is engaged.

In step 120, after having selected a train from among the trains needing to turn around, the operator also selects the zone from which the selected train will be authorized to move in the opposite circulation direction D2 and the destination signal that the selected train must cross to leave the section on which it is engaged.

Advantageously, the zones from which a circulation direction change of the trains is initiated are predetermined. These are for example zones belonging to extended track sections on which several trains can be engaged at the same time. In general, on a section, these zones correspond to waiting zones where a train is brought when an event occurs before the decision is made to enter the downgraded mode. These are essentially zones corresponding to stations, like the zone 24.

Thus, as shown by arrows in FIG. 5, the operator selects the zone 24 as the original zone for the maneuvering and the signal S2 as the destination or output signal.

This information is used by the ATC 18, which, in step 130, traces, i.e., defines, a pseudo-route between the origin zone and the destination signal that are selected in step 120 for the train selected in step 110. This is a pseudo-route, since a route is normally defined between two signaling signals, an origin signal and a destination signal. It is indeed the possibility of choosing a zone, rather than a signal, as origin of a route that allows automatic management of the maneuvering by the signaling system.

Once this pseudo-route is drawn, it is indicated to the CBI 14, which opens it in step 140. To that end, the CBI 14 reserves, for the selected train, the different zones of the pseudo-route between the origin zone (inclusive) and the destination signal, associating, with each of these zones, a circulation direction corresponding to the opposite circulation direction. As shown in FIG. 6 by the arrows pointing from right to left, the pseudo-route PR is opened by the CBI 14 for the train T2 while locking the zones 21 to 24 in the opposite circulation direction D2.

The CBI 14 stores and updates the corresponding sub-routes in the memory 15.

It will be noted that, in FIG. 6, the train T2 being in the zone 24, the sub-routes associated with the sections 24 to 28 of the route R initially followed by the train T2 remain locked, the maintenance conditions being respected.

In parallel, in step 150, the ATS 18, after having drawn the pseudo-route, informs the computer on board the selected train that it must change the current circulation direction of the train so that it corresponds to the opposite circulation direction. Either the train is a fully automated train and the on-board computer itself manages this change of circulation direction; or the train is controlled and the conductor is invited to change cabins such that the active cabin, which was the head cabin when the train was moving in the nominal circulation direction D1, is now the head cabin when the train is moving in the opposite circulation direction D2. This change of active cabin is done securely by using an appropriate key that the conductor must used to indicate the active cabin.

Once the change of active cabin is validated by the on-board computer, the latter sends current circulation direction information of the train to the ZC 16.

In our example, the train T2 therefore informs the ZC that its current circulation direction is now the direction D2.

In the following step 160, the ZC 16, knowing the current circulation direction of the train and receiving, from the CBI 14, the sub-routes locked for this train, calculates a movement authorization for this train. Thus, in our example, the ZC 16 knowing that the train T2 will now circulate in the direction D2, will periodically calculate a movement authorization from sub-routes that have been reserved for it and that correspond to the opposite circulation direction D2.

From one to the next, the movement authorizations calculated by the ZC 16 must allow the train T2 to advance along the pseudo-route PR, until it crosses the destination signal S2 and leaves the section B.

However, it is possible that before beginning the maneuver to change the circulation direction of the train or after this maneuver has been initiated, another train, T3 in FIGS. 5 to 9, will have engaged on the section B, i.e., occupies a zone of the section B and is moving in the nominal circulation direction D1. There is therefore a risk of the train T2 that is now moving in the direction D2 finding itself face-to-face with the train T3 that is moving in the direction D1.

According to the method 100, to guarantee safety and avoid these face-to-face events, the ZC 16 takes account, when it calculates a movement authorization for the considered train, of a list of obstacles. This list of obstacles is kept up to date (step 200) by the ZC 16.

For the train T2 moving in the direction D2, the obstacles are defined from the set of movement authorizations already calculated and sent for performance to the other trains circulating on the section B and moving in the direction D1.

Thus, as illustrated in FIG. 7, if a movement authorization has already been sent to the train T3, this movement authorization authorizing the train T3 to go to the end of the section 22, referenced by the point P, then the point P is considered an obstacle for the train T2.

The ZC 16 then determines the movement authorization for the train T2 taking account of the constraint that the train T2 must not, circulating in the direction D2, be authorized to pass the point P. Thus, the movement authorization sent to the train T2 may not extend past the zone 23.

This approach therefore makes it possible to guarantee the safety of the train circulating in the opposite direction with respect to risks of coming face-to-face with a train controlled using movement authorizations, i.e., a CBTC train or compatible with the CBTC architecture.

However, if one wishes for the circulation on the track 2 to be open to non-CBTC trains, it is also necessary for the ZC 16 to avoid any face-to-face between a train circulating in the opposite direction and a non-CBTC train.

To that end, the ZC 16 determines the zone where, at the current moment, the non-CBTC train is located and calculates, around this instantaneous position, a safety envelope E. This is the case shown in FIG. 8 by the thick line for the train T3, considered in this figure to be a non-CBTC train. The safety envelope E determined by the ZC 16 for the train T3 for example covers the zones 21 and 22.

This safety envelope E constitutes an obstacle in the list to be taken into account to determine a movement authorization for the train T2, since it limits the movement in the direction D2 (but not the direction D1). Thus in FIG. 8, if the safety envelope E of the train T3 extends to the point P, the movement authorization that will be calculated by the ZC 16 for the train T2 may not extend past the point P (in the direction D2). One thus avoids any risk of face-to-face between the train T2, which is a CBTC train, and the non-CBTC train T3.

Once a movement authorization has been calculated for the train T2, it is sent to the on-board computer of the train T2.

The on-board computer of the train T2 controls the train T2 according to this movement authorization. For example, as shown in FIG. 9, if the movement authorization given to the train T2 makes it possible to advance to the point P, the train T2 leaves the zone 24 and advances to the zone 23.

It will be noted that upon leaving the zone 24, the locking conditions of the sub-routes of the route R, in the direction D1, are no longer respected: regarding the sub-route associated with the zone 24 in the direction D1, the train T2 is no longer located in this zone and the sub-route in the direction D1 that precedes (in the direction D1) that of the zone 24, i.e., the sub-route associated with the zone 23, is not locked. As a result, the CBI 14 frees the sub-route 24 for the route R.

From one to the next, all of the sub-routes of the route R are therefore freed, the locking conditions no longer being respected up to the zone 27, which is locked by the train T1.

Upon leaving the zone 24, the locking conditions of the sub-route of the pseudo-route PR associated with the zone 24 in the direction D2 are no longer met, and this sub-route is therefore freed.

Conversely, the train T2 now occupying the zone 23, the sub-route of the pseudo-route PR associated with the zone 23 in the direction D2 is kept locked. The same is true for the sub-routes of the pseudo-route associated with the zones 22 and 21 in the direction D2, since the sub-route of the zone 23, which precedes the zone 23 in the direction D2, is locked.

In step 170, the movement authorization calculated by the ZC 16 is sent to the train for performance. The movement authorization is shown by an arrow in dotted lines in FIGS. 7 and 8.

As long as the train has not crossed the destination signal of the pseudo-route (step 180), the method 100 reiterates step 160 to update the movement authorization of the train.

Thus, for example, the train T3 can be maneuvered so as to turn around. Upon each movement of the train T3, the list of obstacles is updated (step 200) by the ZC 16, which allows it to update a movement authorization for the train T2.

The train T2 progressively moves along the pseudo-route and ultimately crosses the signal S2. It then leaves the section B. This ends the maneuvering and the method 200.

Another case consists of a train T3 that is a CBTC train, but driven manually, the safety mechanisms of the ATP system then being shunted. However, the train T3 communicates the identifier of its active cabin to the ground.

The safety envelope E around the train T3 remains active, preventing a movement in the direction D2 of the train T2 in the corresponding zones only if the active cabin of the train T3 is that on the right in the figures, this active cabin indicating that the train T3 is moving in the direction D1.

Once the active cabin of the train T3 changes to that on the left in the figures, indicating that the train T3 is now circulating in the direction D2, the safety envelope E that was preventing the train T2 from circulating in the direction D2 disappears.

If the train T3 of the CBTC type is non-communicating (in particular if it can no longer indicate its active cabin), there is no way to know the circulation direction of the train T3. In this case, the safety envelope E is systematically taken into account, like for a non-CBTC train. It is therefore only when the train T3 frees a zone that the safety envelope will disappear, allowing the second train T2 to advance over this zone by a movement in the direction D2.

The invention therefore allows the line to be exploited in downgraded mode, authorizing the circulation of the trains over a portion of the track in the direction opposite the nominal circulation direction. The invention makes it possible to control these movements safely.

To that end, the invention defines new objects:

- a pseudo-route defined between an origin region and a destination signal, which allows the interlock to define an alternative route for a train already engaged on a route;
- a sub-route combining the reservation of the zone of a section and a circulation direction on this zone.

The invention is particularly well-suited to a driverless automated subway.

The possibility of a change in circulation direction of a train in a CBTC architecture is a characteristic allowing good flexibility in traffic management and optimal traffic management when blocking operational events occur in the nominal operating mode of the line.

The invention claimed is:

1. A method for managing movement of a train along a section of a railroad track, the method being implemented by a signaling system of the CBTC type that is able, in a nominal mode, to define a route on the section allowing the movement of the train in a nominal circulation direction, the route extending over a plurality of successive zones between an origin signal and a destination signal, wherein the method comprises, when there is an event preventing the train from continuing its movement along the route, causing the train to circulate in a circulation direction opposite the nominal circulation direction by:

selecting an origin zone and an output signal;

tracing, via a supervision system of the signaling system, a pseudo-route for the train, the pseudo-route extending over a plurality of successive zones between the origin zone and the output signal;

opening, via an interlocking system of the signaling system, the pseudo-route by associating each zone of the pseudo-route between the origin zone and the output signal with a sub-route, each sub-route corresponding to the reservation of the associated zone for the train in the opposite circulation direction;

informing the train to modify a current circulation direction thereof so that the current circulation corresponds to the opposite circulation direction;

determining, via a zone controller of the signaling system, a movement authorization for the train taking into account the current circulation direction of the train, the sub-routes open for the train, and a list of obstacles regularly updated by the zone controller; and sending the movement authorization to the train to control the movement of the train, wherein determining and sending a movement authorization is repeated until the train crosses the output signal.

2. The method according to claim 1, wherein the list of obstacles for the train moving in a current circulation direction includes all of the movement authorizations already transmitted to other trains circulating on said section in a circulation direction opposite the current circulation direction.

3. The method according to claim 2, wherein the list of obstacles, for the train moving in a current circulation direction further includes a safety envelope calculated by the zone controller for another non-CBTC train or a non-communicating CBTC train circulating on said section.

4. The method according to claim 2, wherein the list of obstacles for the train moving in a current circulation direction further includes a safety envelope calculated by the zone controller for another CBTC train being driven manually and circulating on said section in a circulation direction opposite the current circulation direction, the circulation direction of said another CBTC train being determined from an identifier of its active cabin.

5. The method according to claim 1, wherein during the opening by the interlocking system of the pseudo-route, the interlocking system locks the sub-routes associated with each zone between the origin zone and the output signal.

6. The method according to claim 5, wherein the interlocking system keeps a sub-route for the train locked as long as:

the train occupies the zone associated with said sub-route; or when the train does not occupy the zone associated with said sub-route, but a neighbor sub-route is locked, said neighbor sub-route being associated with a zone that precedes, in the circulation direction of said pseudo-route, the zone associated with said sub-route.

7. The method according to claim 1, including selecting the train that must circulate in the opposite circulation direction among a plurality of trains engaged on the railroad track section.

8. The method according to claim 1, including defining each zone of the section of the railroad track that may be used as an origin zone of a pseudo-route.

9. A signaling system of the CBTC type for carrying out a method for managing movement of a train along a section of a railroad track according to claim 1, the signaling system comprising a supervision system, a zone controller, and an interlocking system, wherein:

the supervision system is able to trace a pseudo-route between an origin zone and an output signal for the train;

the interlocking system is able to open a pseudo-route tracked by the supervision system by defining, for each zone of the pseudo-route, a sub-route corresponding to the reservation of said zone for the train in a circulation direction that is opposite to a nominal circulation direction; and the zone controller is able to keep a list of obstacles updated and determine a movement authorization for the train taking into account the list of obstacles.

10. The signaling system according to claim 9, wherein the list of obstacles includes movement authorizations sent to other trains circulating on the section.

11. The signaling system according to claim 9, wherein the list of obstacles further includes safety envelopes calculated around a non-CBTC train or a non-communicating CBTC train, circulating on the section.

12. The signaling system according to claim 10, wherein the list of obstacles further includes a safety envelope calculated around a CBTC train being driven manually while circulating on the section, the safety envelope being associated with an identifier of the active cabin of the CBTC train being driven manually.

13. The signaling system according to claim 9, wherein the supervision system is configured so as to define the zones of the section of the railroad track that can be used as origin zone of a pseudo-route.

* * * * *